US011773619B2

(12) United States Patent
Weber et al.

(10) Patent No.: US 11,773,619 B2
(45) Date of Patent: Oct. 3, 2023

(54) DOOR LOCK SYSTEM FOR AN APPLIANCE

(71) Applicant: ELECTROLUX APPLIANCES AKTIEBOLAG, Stockholm (SE)

(72) Inventors: Mario Weber, Rothenburg ob der Tauber (DE); Diego Cremon, Rothenburg ob der Tauber (DE); Trevor Specht, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 218 days.

(21) Appl. No.: 17/263,756

(22) PCT Filed: Jul. 19, 2019

(86) PCT No.: PCT/EP2019/069489
§ 371 (c)(1),
(2) Date: Jan. 27, 2021

(87) PCT Pub. No.: WO2020/025356
PCT Pub. Date: Feb. 6, 2020

(65) Prior Publication Data

US 2021/0301554 A1 Sep. 30, 2021

(30) Foreign Application Priority Data

Aug. 2, 2018 (EP) ..... 18187081

(51) Int. Cl.
*E05B 17/00* (2006.01)
*E05C 5/00* (2006.01)
*F24C 15/02* (2006.01)

(52) U.S. Cl.
CPC ..... *E05B 17/0029* (2013.01); *E05B 17/0025* (2013.01); *E05C 5/00* (2013.01);
(Continued)

(58) Field of Classification Search
CPC ..... Y10S 292/69; Y10T 292/0911; Y10T 292/0956; Y10T 292/1089;
(Continued)

(56) References Cited

U.S. PATENT DOCUMENTS 1,192,105 A * 7/1916 Patterson ..... E05B 65/0811 292/111
4,088,354 A * 5/1978 Kolendowicz ..... F24C 15/022 292/216

(Continued)

FOREIGN PATENT DOCUMENTS

DE 102014202362 8/2015
EP 1703212 A2 * 9/2006 ..... E05B 47/0012
EP 2450510 A2 * 5/2012 ..... A47L 15/4259

OTHER PUBLICATIONS

International Search Report and Written Opinion for PCT/EP2019/069489, dated Nov. 27, 2019, 13 pages.

*Primary Examiner* — Carlos Lugo
(74) *Attorney, Agent, or Firm* — Pearne & Gordon LLP

(57) ABSTRACT

The present invention relates to a door lock system (10) for an appliance, in particular for a domestic appliance, preferably for a cooking oven. The door lock system (10) comprises a hook element (14) pivotable around a pivot axis between an unlocked released state and a locked released state and movable along a main axis perpendicular to said pivot axis between the locked released state and locked pulled state. The door lock system (10) comprises a first sliding member (18) movable along the main axis and provided for pivoting the hook element (14) to the locked released state. The door lock system (10) comprises at least one further sliding member (20, 22) movable along the main axis and provided for pulling the hook element (14) to the locked pulled state.

15 Claims, 5 Drawing Sheets

(52) U.S. Cl.
CPC ..... *F24C 15/022* (2013.01); *Y10S 292/69* (2013.01); *Y10T 292/1082* (2015.04)

(58) Field of Classification Search
CPC ..... Y10T 292/1021; Y10T 292/1082; E05B 17/0025; E05C 5/00
See application file for complete search history.

(56) References Cited

U.S. PATENT DOCUMENTS

| | | | | |
|---|---|---|---|---|
| 4,703,960 | A * | 11/1987 | Lense | E05B 47/0012 292/201 |
| 5,401,067 | A | 3/1995 | Kurosaki et al. | |
| 6,315,336 | B1 * | 11/2001 | Swartzell | E05B 47/0012 292/201 |
| 7,481,469 | B2 * | 1/2009 | Harrer | H05B 6/6417 292/201 |
| 8,109,543 | B2 * | 2/2012 | Chirumbolo | E05B 15/101 292/201 |
| 8,733,802 | B2 * | 5/2014 | Promutico | D06F 39/14 292/216 |
| 9,587,837 | B2 * | 3/2017 | Colucci | F24C 14/02 |
| 10,876,735 | B2 * | 12/2020 | Ivanovic | F24C 14/02 |
| 2006/0012187 | A1 | 1/2006 | Adachi et al. | |
| 2007/0080546 | A1 | 4/2007 | Chou | |
| 2013/0234578 | A1 | 9/2013 | Gianbattista et al. | |
| 2018/0087778 | A1 * | 3/2018 | Ivanovic | E05B 47/023 |

* cited by examiner

DOOR LOCK SYSTEM FOR AN APPLIANCE

The present invention relates to a door lock system for an appliance. In particular, the present invention relates to a door lock system for a domestic appliance. Preferably, the present invention relates to a door lock system for a cooking oven. Further, the present invention relates to an appliance with a door lock system.

The door of an appliance, in particular of a cooking oven, is often closed by the closing force of door hinges. Said closing force pushes the door towards a front frame and compresses a gasket. On the one hand, the closing force generated by the door hinges is strong enough to overcome the internal pressure of a cavity, e.g. of an oven cavity during a cooking process. On the other hand, said closing force should be sufficiently weak in order to obtain an achievable opening force for the user.

Further, there are lock mechanisms for oven doors, which avoid an opening of the oven door during specific functions, e.g. during a pyrolytic self-cleaning function, or by unauthorised persons, e.g. children. These lock mechanisms are mechanical or electromechanical devices with a hook element or the like.

It is an object of the present invention to provide a door lock system that increase the closing force of the door, wherein the door lock system allows the use of door hinges generating low opening forces.

According to the present invention a door lock system for an appliance, in particular for a domestic appliance, preferably for a cooking oven is provided, wherein the door lock system comprises:

- a hook element pivotable around a pivot axis between an unlocked released state and a locked released state and movable along a main axis perpendicular to said pivot axis between the locked released state and a locked pulled state,
- a first sliding member movable along the main axis and provided for pivoting the hook element to the locked released state, and
- at least one further sliding member movable along the main axis and provided for pulling the hook element to the locked pulled state.

The core of the present invention is that the hook element is pivotable between the unlocked released state and the locked released state on the one hand and movable between the locked released state and the locked pulled state on the other hand, wherein said hook element is driven by the sliding members being movable along the main axis.

Preferably, in the unlocked released state, wherein the system is not interacting with the door, the user is allowed to open and close the door without any deviation from what is the normal functioning of an oven. Particularly, in the locked released state, wherein the system is locking the door without applying a pulling force, the device is locking the door without pulling it in order to avoid an opening of the door itself during specific functions or for safety reasons in order to prevent the opening of the door by not allowed persons, e.g. children. In other words, the device in this position can cover also the function of a so-called standard pyro latch. Preferably, in the unlocked pulled state, wherein the system is pulling the door without locking the door itself, the system pulls the door against the front frame through the gasket without locking it. In this position, if the user tries to open the door, then he is able to open said door like a standard oven, wherein however a greater force is needed to open the door. The force for pulling is bigger, since it is necessary to overcome the force given by a spring element.

For example, pulling the door forces an upper arm to slide, while a lower arm maintains the same position. In this condition the hook is disengaged and can rotate upwards allowing the opening of the door. Optionally, there is also a fourth state, namely a locked pulled state, wherein the system is pulling the door and locking said door itself. In this state, the device avoids the manual opening of the door during the pulling function and the opening of the door itself during specific functions or for safety reason to prevent the opening of the door by not allowed persons, e.g. children.

Preferably, the door lock system comprises at least one motor for driving the sliding members.

In particular, the door lock system comprises at least one cam driven or drivable by the motor and provided for driving the sliding members, wherein preferably the cam includes at least two eccentric disks provided for driving the first sliding member and the further sliding member, respectively.

Further, the door lock system may comprise at least one detecting element for detecting the presence and/or proximity of a counterpart engageable with the hook element, wherein preferably the detecting element is movable along the main axis.

Additionally, the door lock system may comprise at least one first switch element switchable by the detecting element.

In particular, the door lock system comprises at least one base part formed as a casing and/or a frame, wherein the hook element, the sliding members, the cam and/or the detecting element are arranged within or at said base part.

Preferably, the door lock system comprises a second sliding member and a third sliding member movable along the main axis and provided for pulling the hook element to the locked pulled state.

In the preferred embodiment, the second sliding member and the third sliding member are arranged in series, wherein said series is arranged parallel to the first sliding member.

Additionally, the door lock system may comprise a first spring element between the first sliding member and the base part, a second spring element between the second sliding member and the base part, a third spring element between the third sliding member and the second sliding member and/or a fourth spring element between the detecting element and the base part.

Further, the door lock system may comprise a second switch element responding to the locked released state, wherein preferably the second switch element is switchable by the first sliding member.

Moreover, the door lock system comprises a third switch element responding to the locked pulled state, wherein preferably the third switch element is switchable by the second sliding member.

In particular, the door lock system comprises a push element for holding the hook element in the unlocked state, wherein preferably a fifth spring element is arranged between said push element and the base part.

Additionally, the door lock system may comprise a fixation element for attaching the door lock system to a carrier, wherein preferably a sixth spring element is arranged between said fixation element and the base part in order to compensate a deviation from the intended position of the counterpart engageable with the hook element along an axis perpendicular to the main axis and the pivoting axis.

For example, the third spring element between the third sliding member and the second sliding member provides a compensation of a deviation from the intended position of the counterpart engageable with the hook element along the main axis.

Further, the present invention relates to an appliance, in particular a domestic appliance, preferably a cooking oven, wherein the appliance comprises at least one door lock system mentioned above.

Novel and inventive features of the present invention are set forth in the appended claims.

The present invention will be described in further detail with reference to the drawing, in which FIG. 1 illustrates a schematic exploded perspective view of a door lock system according to a preferred embodiment of the present invention, FIG. 2 illustrates a schematic perspective view of the door lock system according to the preferred embodiment of the present invention, FIG. 3 illustrates a schematic sectional side view of the door lock system according to the preferred embodiment of the present invention, FIG. 4 illustrates a schematic top view of the door lock system according to the preferred embodiment of the present invention, FIG. 5 illustrates a schematic detailed sectional side view of a hook element in an unlocked released state of the door lock system according to the preferred embodiment of the present invention, FIG. 6 illustrates a schematic detailed sectional side view of the hook element in a locked released state of the door lock system according to the preferred embodiment of the present invention, FIG. 7 illustrates a schematic detailed sectional side view of the hook element in a locked pulled state of the door lock system according to the preferred embodiment of the present invention, FIG. 8 illustrates a schematic detailed perspective view of the hook element in the unlocked released state of the door lock system according to the preferred embodiment of the present invention, FIG. 9 illustrates a schematic detailed perspective view of the hook element in the locked released state of the door lock system according to the preferred embodiment of the present invention, and FIG. 10 illustrates a schematic sectional perspective view of the door lock system according to the preferred embodiment of the present invention attached at an appliance.

FIG. 1 illustrates a schematic exploded perspective view of a door lock system 10 according to a preferred embodiment of the present invention.

The door lock system 10 comprises a base part 12, a hook element 14 and a pivot 16. For example, the base part 12 is formed as a casing or a frame. The hook element 14 is attached by the pivot 16 within the base part 12, wherein the hook element 14 partially sticks out of said base part 12. The hook element 14 is slidable along its longitudinal axis and pivotable around the axis of the pivot 16. The hook element 14 includes a hook engageable with a counterpart. The sliding movement of the hook element 14 is performed by sliding the pivot 16 perpendicular to the axis of said pivot 16. In this example, the pivot 16 is slidable between two guiding rails of the base part 12. Preferably, the pivot 16 is formed as a metal pin.

Further, the door lock system 10 comprises a first sliding member 18, a second sliding member 20 and a third sliding member 22. The sliding members 18, 20 and 22 are movable within the base part 12 along a main axis perpendicular to the axis of the pivot 16. The second sliding member 20 and the third sliding member 22 are arranged in series. The first sliding member 18 is arranged parallel to the series of the second sliding member 20 and third sliding member 22.

Additionally, the door lock system 10 comprises a first spring element 24, a second spring element 26 and a third spring element 28 corresponding with the first sliding member 18, the second sliding member 20 and the third sliding member 22, respectively. The first spring element 24 acts between the first sliding member 18 and the base part 12. The second spring element 26 acts between the second sliding member 20 and the base part 12. The third spring element 28 acts between the second sliding member 20 and the third sliding member 22.

Furthermore, the door lock system 10 comprises a motor 36 and a cam 38. The motor 36 is provided for driving the cam 38. In this example, the cam 38 is a single-piece part and includes two eccentric disks 40 and 42 having a common axis. The first eccentric disk 40 acts on the first sliding member 18, so that a rotation of the motor 36 and the cam 38 results in a movement of the first sliding member 18. The second disk 42 acts on the second sliding member 20, so that the rotation of the motor 36 and the cam 38 results in a movement of the second sliding member 20.

Additionally, the door lock system 10 comprises a detecting element 44 and a fourth spring element 46. The detecting element 44 is arranged partially within the base part 12 and partially sticks out of said base part 12. The detecting element 44 is movable along the main axis. The detecting element 44 is arranged beside the hook element 14. The fourth spring element 46 acts between the detecting element 44 and the base part 12.

Further, the door lock system 10 comprises a push element 48, a fifth spring element 50, a fixation element 52 and a sixth spring element 54. The fifth spring element 50 acts between the push element 48 and the base part 12. The push element 48 is provided for pushing the hook element 14 into an unlocked position. The sixth spring element 54 acts between the fixation element 52 and the base part 12. The fixation element 52 is provided for fixing the base part 12 on a carrier of the appliance or a door 60.

Moreover, the door lock system 10 comprises a first switch element 30, a second switch element 32 and a third switch element 34. The first switch element 30 responds to the presence or proximity of the door 60, if the detecting element 44 is moved against the first switch element 30 by said door 60. Alternatively, the first switch element 30 responds to the presence or proximity of a front frame of the appliance, if the door lock system 10 is attached at the door 60. The second switch element 32 responds to a locked position of the hook element 14. The third switch element 34 responds to a pulled position of the hook element 14.

The door lock system 10 is either in an unlocked released state, a locked released state or a locked pulled state. In the unlocked released state of the door lock system 10, the hook of the hook element 14 is not engaged with the counterpart. In the locked released state of the door lock system 10, the hook of the hook element 14 engages with the counterpart. In the locked pulled state of the door lock system 10, the hook of the hook element 14 pulls the counterpart towards said door lock system 10. For example, the counterpart is a recess in the door 60 or in the front frame, respectively.

The first sliding member 18 is provided for pivoting the hook element 14 by a movement along the main axis. In the preferred embodiment, the hook of the hook element 14 is engaged or engageable with the counterpart, when the first sliding member 18 is pushed towards the hook element 14. In this example, the hook element 14 is formed as a two-armed lever, wherein the one lever-arm includes the hook, while the other lever-arm is pushed or pushable by the first sliding member 18. The movement of the first sliding member 18 towards the hook element 14 effects the transition from the unlocked released state to the locked released state of the door lock system 10. The first sliding member 18 is driven by the motor 36 via the first eccentric disk 40 of the cam 38.

The second sliding member 20 and the third sliding member 22 are provided for the pulling the hook element 14 into its pulled position. In this example, a hook of the third sliding member 22 engages with an edge of the hook element 14.

FIG. 2 illustrates a schematic perspective view of the door lock system 10 according to the preferred embodiment of the present invention.

The components of the door lock system 10 are substantially arranged within the base part 12. In FIG. 2, the door lock system 10 is in the unlocked released state. FIG. 2 clarifies, that the hook element 14 and the detecting element 44 are arranged side by side.

FIG. 3 illustrates a schematic sectional side view of the door lock system 10 according to the preferred embodiment of the present invention.

In FIG. 3, the door lock system 10 is in the unlocked released state. The first sliding member 18 is in contact with the hook element 14. A movement of said first sliding member 18 towards the hook element 14 would effect that the hook element 14 pivots form the unlocked position to the locked position. The hook element 14 is kept in the unlocked position by the push element 48.

FIG. 4 clarifies the arrangement of the components of the door lock system 10.

Figure 1:
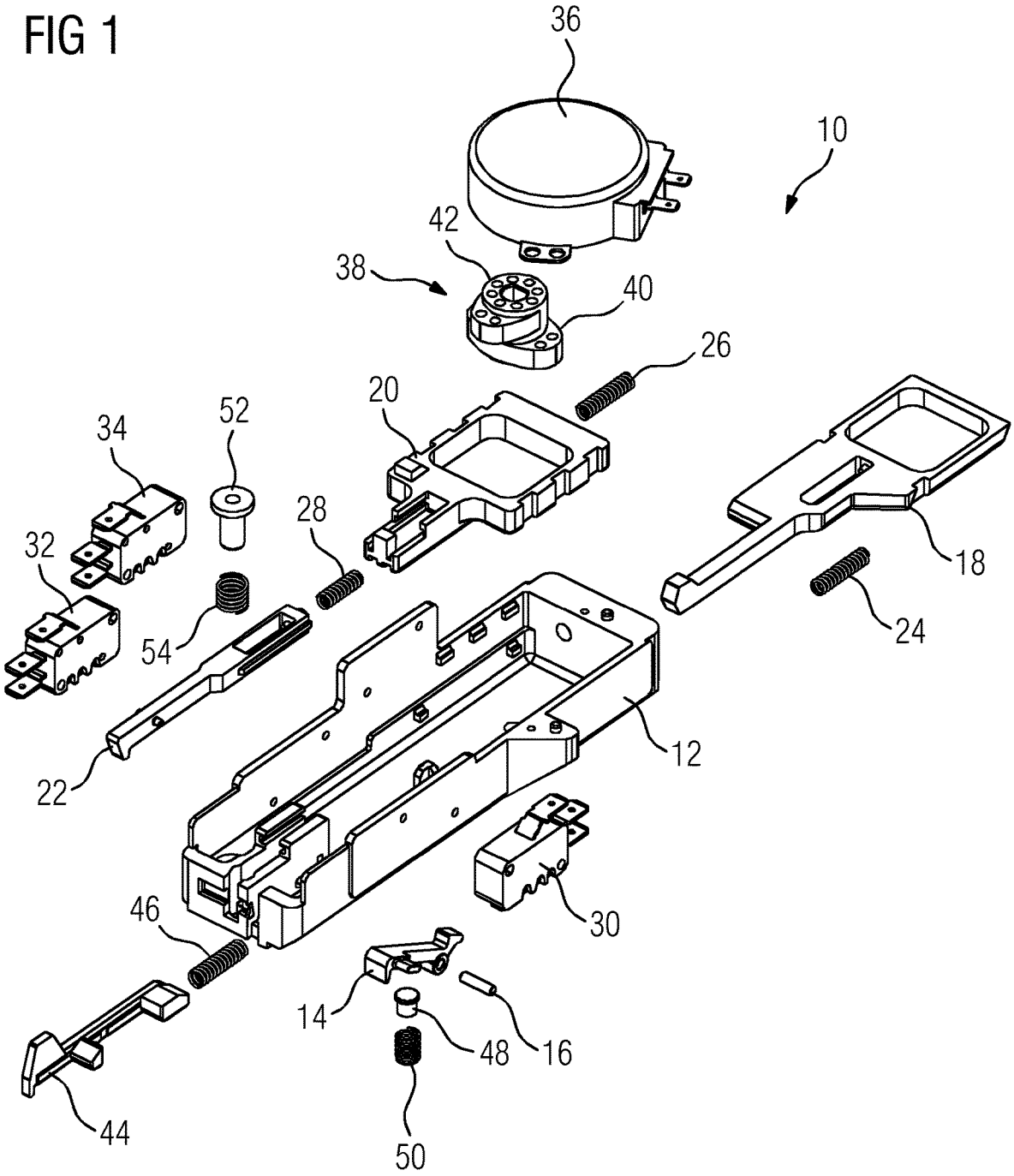
Figure 2:
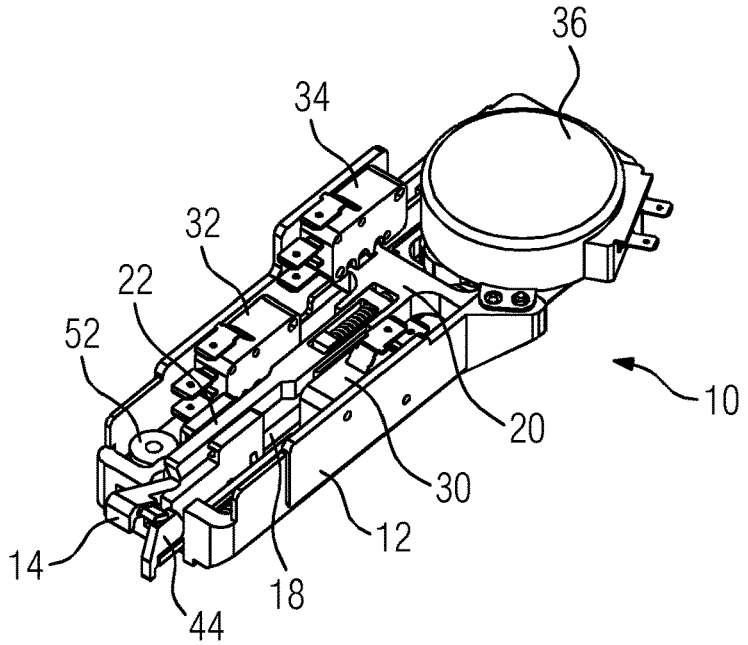
Figure 3:
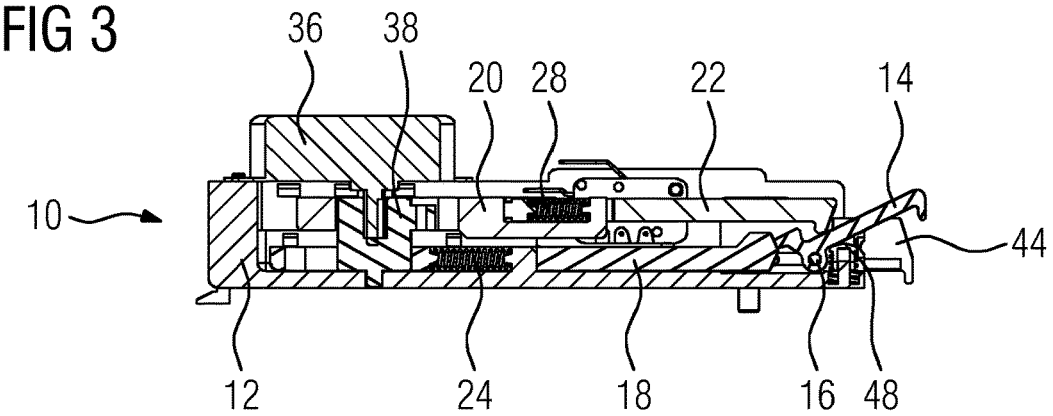
Figure 4:
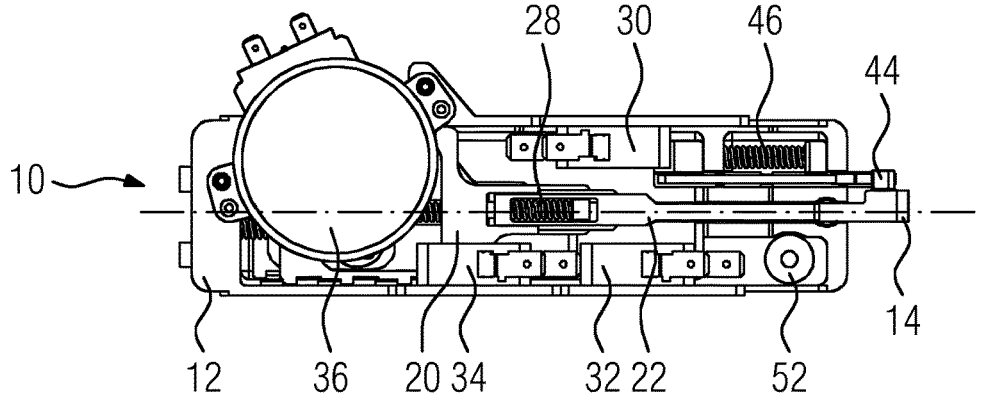
FIG. 4 illustrates a schematic top view of the door lock system 10 according to the preferred embodiment of the present invention.

When the door 60 is open, the door lock system 10 is in the unlocked released state. When the door 60 is manually closed, then the detecting element 44 is moved towards the first switch element 30 by the door 60. Then, the first switch element 30 sends a signal to a control device, so that the motor 36 can be activated manually by the user or automatically by the control device, when the motor 36 is activated it turns and drives the cam 38. In turn, the first eccentric disk 40 of the cam 38 drives the first sliding member 18, which is shown in FIG. 6.

Figure 6:
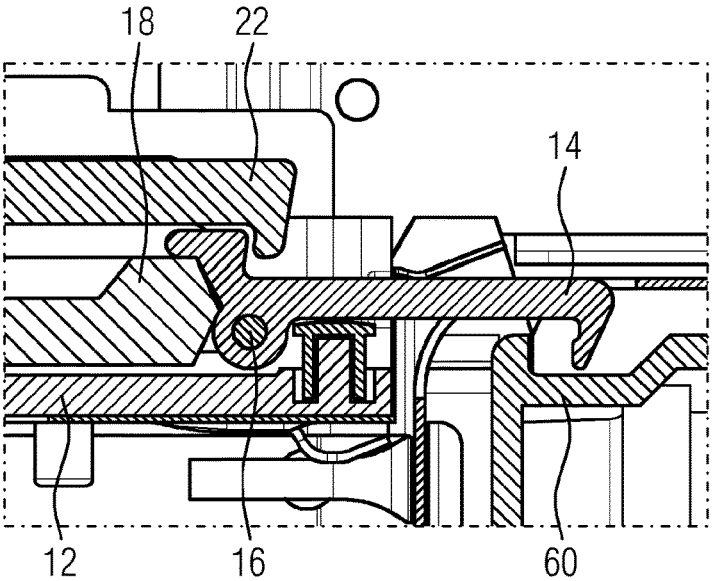

FIG. 6 illustrates a schematic detailed sectional side view of the hook element 14 in the locked released state of the door lock system 10 according to the preferred embodiment of the present invention.

The first sliding member 18 has pushed the hook element 14 in the locked position, wherein the hook element 14 has been pivoted around the pivot 16. The movement of the first sliding member 18 is stopped by deactivating the motor 36, after the second switch element 32 has detected the locked position of the hook element 14 and has sent a corresponding signal to the control device. The locked released state of the door lock system 10 is reached, when the movement of the first sliding member 18 has been stopped.

In this example, the clearance between the hook of the hook element 14 and the counterpart at the door 60 is about 4 mm.

In the locked released state of the door lock system 10 the door 60 is locked, but not pulled against the front frame. This avoids that the door 60 may be opened by any specific function. Further, there are safety reasons that the door 60 cannot be opened by unauthorised persons, e.g. children.

Figure 7:
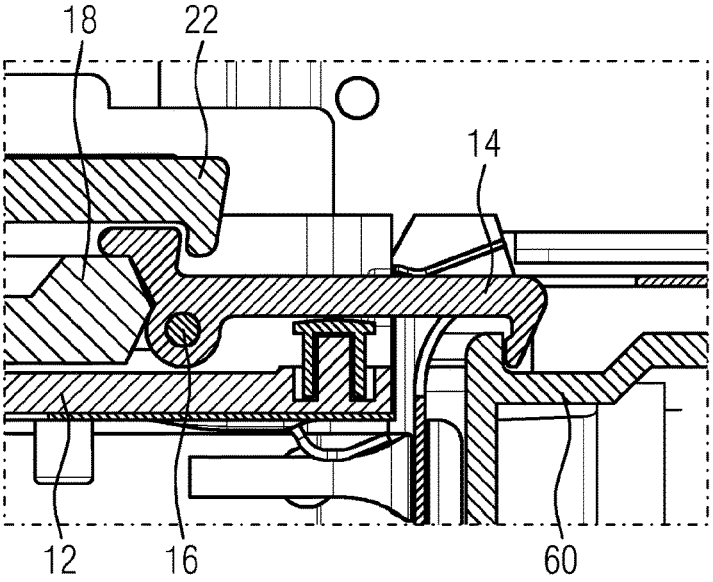

FIG. 7 illustrates a schematic detailed sectional side view of the hook element 14 in a locked pulled state of the door lock system 10 according to the preferred embodiment of the present invention. In FIG. 7, the door 60 is pulled towards the front frame of the appliance, wherein said door 60 engages with the hook element 14.

A pulling function may be requested manually by the user or automatically by the control device. If the pulling function is requested, then the signal from the second switch element 32 indicating the locked position does not stop the motor 36 via the control device. The further rotation of the motor 36 and the cam 38 effect a movement of the first sliding member 18, the second sliding member 20 and the third sliding member 22 with the hook element 14. The simultaneous movement of the first sliding member 18, the second sliding member 20 and the third sliding member 22 pulls the hook element 14 with the door 60 and so pulls the door 60 to the front frame without pivoting said hook element 14. This is enabled by the guiding rails of the base part 12, in which the pivot 16 is slidable.

The simultaneous movement of the first sliding member 18, the second sliding member 20 and the third sliding member 22 is stopped, when the second sliding member 20 reaches the third switch element 34. The third switch element 34 sends a signal to the control device, so that the motor 36 and the cam 38 are stopped. After the simultaneous movement of the first sliding member 18, the second sliding member 20 and the third sliding member 22 has been stopped, the door lock system 10 is in the locked pulled state.

In the locked pulled state of the door lock system 10 the user is able to open the door 60. However, a bigger force is required for opening said door 60 as in a conventional appliance. When the door 60 is pulled by the user, then the third sliding member 22 is moved along the main axis, while the first sliding member 18 and the second sliding member 20 remain in its position. This is possible, since the second sliding member 20 and the third sliding member 22 are coupled by a sliding system allowing a relative movement between the two parts. The third spring element 28 gives the resistance force, which needs to be overcome in order to create said relative movement, and which is translated in a bigger force to be applied to the handle. In this condition, the hook element 14 is pivotable and the door 60 can be opened.

Once the door 60 is opened, the first switch element 30 sends a signal to the control device. Then, the motor 36 is activated again in order to obtain the unlocked released state of the door lock system 10. This avoids issues linked to a further closing of the door 60. When the door 60 is closed again by the user, the door lock system 10 reaches the locked pulled state.

Figure 5:
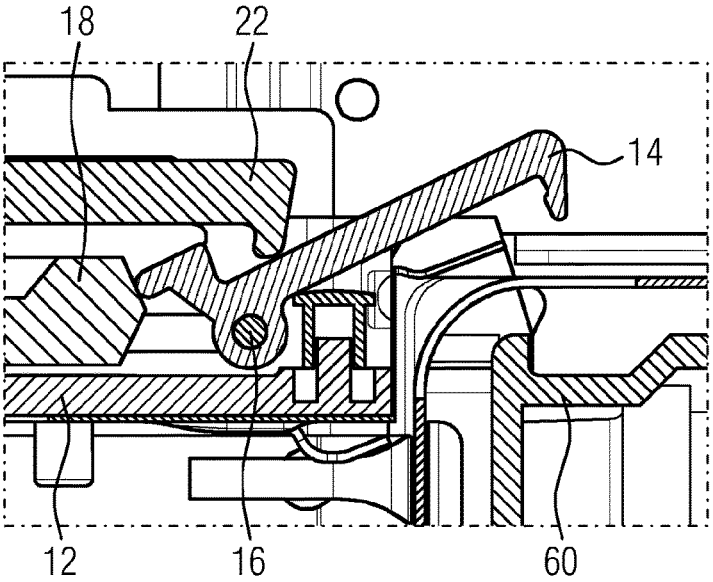
FIG. 5 illustrates a schematic detailed sectional side view of the hook element 14 in the unlocked released state of the door lock system 10 according to the preferred embodiment of the present invention.

The end of the locked pulled state the door lock system 10 is requested manually by the user or automatically by the control device. When the end of the locked pulled state the door lock system 10 is requested, then the motor 36 and the cam 38 are activated again and start to rotate. The first sliding member 18, the second sliding member 20 and the third sliding member 22 are simultaneously moved towards the hook element 14, so that the door lock system 10 reaches the locked released state. Then, a signal from the second switch element 32 is sent to the control device without deactivating the motor 36. Said signal is only a stroke check. The motor 36 and the cam 38 rotate further, so that the first sliding member 18 is moved away and disengaged from the hook element 14. Then, the hook element 14 is pivoted to the unlocked position by the push element 48 due to force of the fifth spring element 50. After that, the rotation of the motor 36 and the movement of the first sliding member 18 are stopped by a time control. For example, the rotation of the motor 36 and the movement of the first sliding member 18 are stopped a certain time after the first sliding member 18 has been disengaged from the hook element 14. When the movement of the first sliding member 18 has been finished, then the door lock system 10 is in the unlocked released state shown in FIG. 5.

In this example, the pulling stroke is about 6 mm, wherein the clearance between the hook of the hook element 14 and the counterpart at the door 60 of about 4 mm has to be overcome, while the door 60 is pulled over a distance of about 2 mm.

Figure 8:
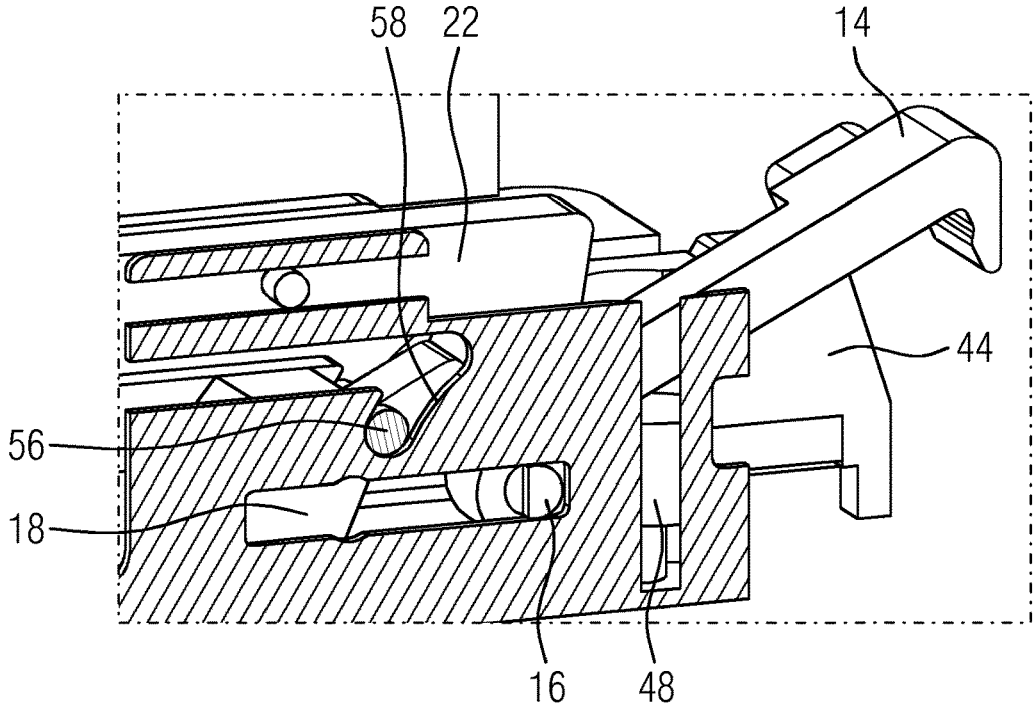

FIG. 8 illustrates a schematic detailed perspective view of the hook element 14 in the unlocked released state of the door lock system 10 according to the preferred embodiment of the present invention.

Optionally, the hook element 14 includes at least one lateral appendix 56, while the base part 12 includes a corresponding slotted guide system 58. In this example, the hook element 14 includes two lateral appendices 56 and the base part 12 includes two slotted guide systems 58. The lateral appendices 56 and the slotted guide systems 58 provide mechanical constraints for the movement and the pivoting the hook element 14. In this example, the slotted guide system 58 has the shape of the numeral "1". The slotted guide systems 58 guarantee that the pivoting of the hook element 14 is allowed in one position only. In this example, the pivoting of the hook element 14 is allowed only in the outermost position of the linear route of said hook element 14. In FIG. 8 the positions of the lateral appendices 56 in view of the slotted guide systems 58 are shown for the unlocked released state of the door lock system 10.

Figure 9:
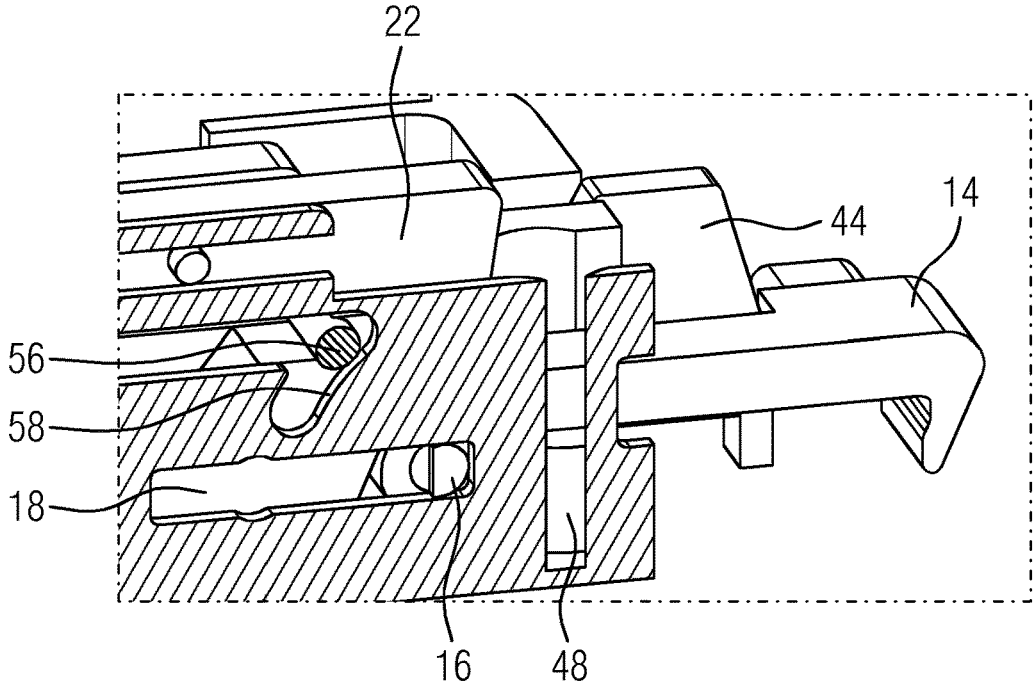

FIG. 9 illustrates a schematic detailed perspective view of the hook element 14 in the locked released state of the door lock system 10 according to the preferred embodiment of the present invention.

In FIG. 9 the positions of the lateral appendices 56 in view of the slotted guide systems 58 are shown for the locked released state of the door lock system 10.

Figure 10:
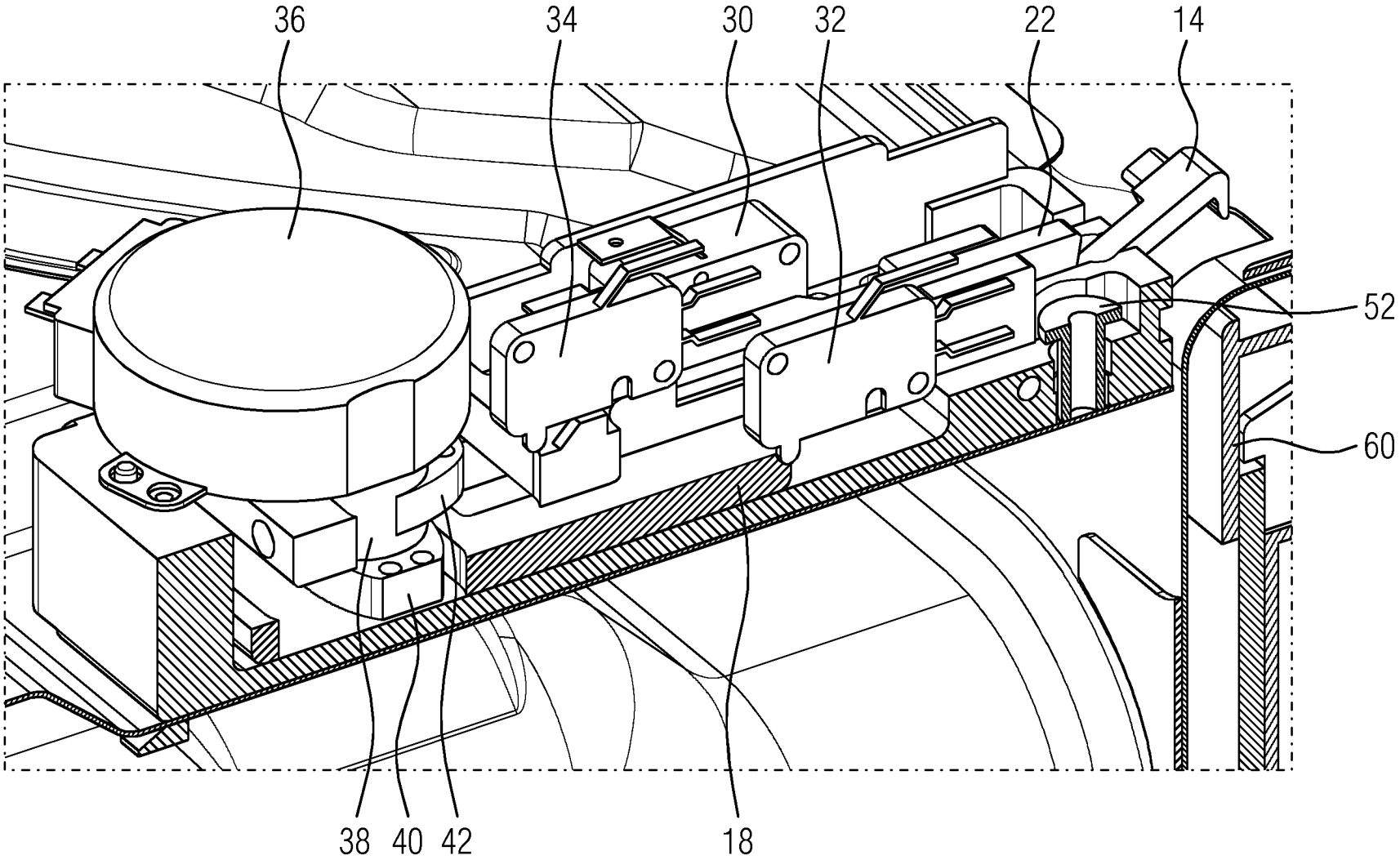

FIG. 10 illustrates a schematic sectional perspective view of the door lock system 10 according to the preferred embodiment of the present invention attached at an appliance.

The door lock system 10 is attached at a chassis of the appliance, wherein the hook element 14 and the detecting element 44 penetrate the front frame of said appliance.

The door lock system 10 includes tolerance compensation along the direction perpendicular to the main axis of said door lock system 10 and to the pivoting axis of the hook element 14. The door lock system 10 is fixed to the chassis by a locating system, two pins and a single fixation screw. Said two pins are arranged at the end portion close to the hook element 14, while the locating system is arranged at the opposite end portion of the door lock system 10. The fixation screw connects the fixation element 52 to the chassis, wherein the sixth spring element 54 is arranged between the fixation element 52 and the base part 12. The sixth spring element 54 allows a movement of the base part 12 relative to the fixation element 52. This allows a compensation of a deviation from the intended position of the door 60. For example, if the door 60 is higher than intended, then the position of door lock system 10 is adapted during the hook element 14 reaches the locked position. Thus, the sixth spring element 54 compensates the deviation from the intended position of the door 60.

Further, the door lock system 10 includes tolerance compensation along the main axis of said door lock system 10. The third spring element 28 between the second sliding member 20 and the third sliding member 22 allows relative movements of between said second sliding member 20 and third sliding member 22. The third spring element 28 maintains the intended distance between the second sliding member 20 and the third sliding member 22 and their intended positions to the hook element 14. If the door 60 is not in the intended position along the main axis, when the pulling function is activated, then the third spring element 28 compensates this deviation. In this example, the third spring element 28 is a compression spring.

The door lock system 10 according to the present invention may adopt three states, i.e. the unlocked released state, the locked released state and the locked pulled state. A transition from the unlocked released state to the locked released state is possible. Inversely, a transition from the locked released state to the unlocked released state is also possible. Further, a transition from the locked released state to the locked pulled state is possible, while the inverse transition from the locked pulled state to the locked released state is also possible. However, a transition from the unlocked released state to the locked pulled state and the inverse transition from the locked pulled state to the unlocked released are not allowed.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 door lock system
12 base part
14 hook element
16 pivot
18 first sliding member
20 second sliding member
22 third sliding member
24 first spring element
26 second spring element
28 third spring element
30 first switch element
32 second switch element
34 third switch element
36 motor
38 cam
40 first eccentric disk
42 second eccentric disk
44 detecting element
46 fourth spring element
48 push element
50 fifth spring element
52 fixation element
54 sixth spring element
56 lateral appendix
58 slotted guide system
60 door, oven door

The invention claimed is:

1. A door lock system for a domestic appliance, comprising:

a hook element pivotable around a pivot axis between an unlocked released state and a locked released state and movable along a main axis perpendicular to said pivot axis between the locked released state and a locked pulled state, a first sliding member movable along the main axis and configured to pivot the hook element to the locked released state, a second sliding member movable along the main axis and configured to pull the hook element to the locked pulled state, a motor configured to drive the first and second sliding members, and a cam driven by the motor and configured to drive the first and second sliding members, wherein the cam includes at least two eccentric disks configured to drive the first and second sliding members, respectively.

2. The door lock system according to claim 1, further comprising a detecting element configured to detect a presence and/or proximity of a counterpart engageable with the hook element, wherein the detecting element is movable along the main axis.

3. The door lock system according to claim 2, further comprising a first switch element switchable by the detecting element.

4. The door lock system according to claim 3, further comprising a second switch element responding to the locked released state, wherein the second switch element is switchable by the first sliding member.

5. The door lock system according to claim 4, further comprising a third switch element responding to the locked pulled state, wherein the third switch element is switchable by the second sliding member.

6. The door lock system according to claim 2, further comprising a fixation element for attaching the door lock system to a carrier, wherein a fixation spring element is arranged between said fixation element and a base part formed as a casing and/or a frame.

7. The door lock system according to claim 1, further comprising a base part formed as a casing and/or a frame, wherein the hook element, the first and second sliding members, the cam and/or the detecting element are arranged within or at the base part.

8. The door lock system according to claim 1 further comprising a third sliding member, wherein the second sliding member and the third sliding member are both movable along the main axis and configured to pull the hook element to the locked pulled state.

9. The door lock system according to claim 8, wherein the second sliding member and the third sliding member are arranged in series, wherein said series is arranged parallel to the first sliding member.

10. The door lock system according to claim 8, further comprising, a first spring element between the first sliding member and a base part, a second spring element between the second sliding member and the base part, a third spring element between the third sliding member and the second sliding member and/or a fourth spring element between a detecting element and the base part.

11. The door lock system according to claim 10, further comprising a push element for holding the hook element in the unlocked released state, wherein a fifth spring element is arranged between said push element and the base part.

12. The door lock system according to claim 10, wherein the third spring element between the third sliding member and the second sliding member provides a compensation of a deviation from an intended position of the counterpart engageable with the hook element along the main axis.

13. A cooking oven comprising the door lock system according to claim 1.

14. A door lock system for a domestic appliance, comprising:

a hook pivotable between an unlocked orientation and a locked orientation about a pivot axis, said hook being linearly translatable along a main axis of the system that is perpendicular to said pivot axis, said hook being biased in said unlocked orientation by a first spring, wherein said hook is adapted to interfere with a counterpart in said locked orientation and to avoid interference with said counterpart in said unlocked orientation in order to reversibly lock and unlock a door of said appliance, respectively;

a first sliding member movable along the main axis relative to said pivot axis and engageable with said hook such that translation of said first sliding member in a first direction along the main axis toward said pivot axis causes said hook to pivot into said locked orientation against the bias of said first spring, and that translation of said first sliding member in a second direction along the main axis opposite the first direction allows said hook to return to said unlocked orientation in accordance with the bias of said first spring;

a second sliding member and a third sliding member both slidably engaged with one another and movable along the main axis, said second and third sliding members together being arranged in series with one another and in parallel with respect to the first sliding member; and a motor coupled with and adapted to rotatably drive a cam relative to a cam axis, said cam comprising first and second eccentric disks, the first eccentric disk engageable with and adapted to drive the first sliding member in said first direction upon actuation of said motor to rotate the cam to at least a first rotational extent about said cam axis, the second eccentric disk engageable with and adapted to drive the second sliding member in said first direction upon actuation of said motor to rotate the cam beyond said first rotational degree toward a second rotational extent about said cam axis;

wherein actuation of the motor to drive the cam to at least said first rotational degree correspondingly advances the first sliding member in said first direction via engagement with said first eccentric disk, thereby pivoting said hook into said locked orientation; and wherein further actuation of said motor to drive the cam beyond said first rotational degree toward said second rotational degree correspondingly withdraws the second and third sliding members in said second direction via engagement of said second sliding member with said second eccentric disk, said third sliding member thereby engaging with and drawing said hook, in the locked orientation thereof and together with said first sliding member, also in said second direction, such that said hook physically engages and pulls against said counterpart and thereby draws said door toward the appliance.

15. The door lock system according to claim 14, further comprising a detecting element configured to detect a proximity of the counterpart to said hook, a first switch switchable by the detecting element, a second switch switchable by the first sliding member and a third switch switchable by the second sliding member, a controller operatively coupled to each of the first, second and third switches and to the motor, said controller being configured:

to operate the motor to drive said cam upon actuation of said first switch by said detecting element corresponding to a selected proximity between said hook and said counterpart, in the absence of a pulling-function request, to deactivate the motor upon actuation of said second switch by said first sliding member, corresponding to said cam having reached said first rotational degree and to said hook having reached its locked orientation via interaction thereof with said first sliding member, corresponding to a locked released state of the system, and in the presence of said pulling-function request, to continue operation of said motor to drive the cam beyond said first rotational degree toward said second rotational degree and thereafter to deactivate the motor upon actuation of said third switch by said second sliding member, corresponding to said first, second and third sliding members and said hook in the locked orientation thereof having all together been withdrawn in said second direction along said main axis to a predetermined extent, corresponding to a locked pulled state of the system.

* * * * *